US008539694B2

(12) United States Patent
Moon et al.

(10) Patent No.: US 8,539,694 B2
(45) Date of Patent: Sep. 24, 2013

(54) CLOTHES TREATMENT APPARATUS

(75) Inventors: Jung Wook Moon, Seoul (KR); Sog Kie Hong, Seoul (KR); Dong Won Kim, Seoul (KR); Seung Gyu Ryu, Seoul (KR); Hye Yong Park, Seoul (KR); Chang Gyu Choi, Seoul (KR); Dae Yun Park, Seoul (KR); Jong Seok Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 275 days.

(21) Appl. No.: 13/083,137

(22) Filed: Apr. 8, 2011

(65) Prior Publication Data

US 2011/0271545 A1 Nov. 10, 2011

Related U.S. Application Data

(63) Continuation-in-part of application No. 12/219,947, filed on Jul. 30, 2008, now abandoned.

(30) Foreign Application Priority Data

Aug. 3, 2007 (KR) ..... 10-2007-0078122
Aug. 3, 2007 (KR) ..... 10-2007-0078173

(51) Int. Cl.
*F26B 25/16* (2006.01)

(52) U.S. Cl.
USPC ..... 34/606; 34/610; 68/20; 8/149.1

(58) Field of Classification Search
USPC ..... 34/218, 595, 601, 90, 606, 610; 68/3 R, 68/5 C, 19, 20; 8/149.3, 149.1
See application file for complete search history.

(56) References Cited

U.S. PATENT DOCUMENTS

| | | | | |
|---|---|---|---|---|
| 2,297,230 | A | | 9/1942 | Langen |
| 2,931,149 | A | | 4/1960 | Mitchell |
| 3,089,327 | A | | 5/1963 | Stilwell, Jr. |
| 3,121,000 | A | | 2/1964 | Hubbard |
| 3,155,462 | A | | 11/1964 | Erickson et al. |
| 3,234,571 | A | | 2/1966 | Buss |
| 3,285,155 | A | * | 11/1966 | Maltenfort ..... 454/359 |
| 3,402,576 | A | | 9/1968 | Krupsky |
| 3,849,815 | A | | 11/1974 | Frauendorf |
| 3,866,333 | A | * | 2/1975 | Sarukahanian et al. ..... 34/75 |
| 4,112,590 | A | * | 9/1978 | Muller ..... 34/75 |
| 4,603,489 | A | * | 8/1986 | Goldberg ..... 34/77 |
| 4,682,424 | A | * | 7/1987 | Irving ..... 34/621 |
| 5,369,892 | A | | 12/1994 | Dhaemers |

(Continued)

FOREIGN PATENT DOCUMENTS

| | | |
|---|---|---|
| CH | 508 085 A | 5/1971 |
| CN | 1540059 | 10/2004 |

(Continued)

*Primary Examiner* — Steve M Gravini
(74) *Attorney, Agent, or Firm* — McKenna Long & Aldridge LLP

(57) ABSTRACT

A clothes treatment apparatus is disclosed. The clothes treatment apparatus includes a cabinet comprising an accommodating space formed therein to accommodate clothes, an air supply device configured to supply air or heated air to the accommodating space, a duct configured to guide the air or the heated air supplied by the air supply device toward the accommodating space, the duct comprising a communication part configured to draw external air into the accommodating space and a circulation fan configured to flow air along the duct, wherein the communication part is located in a rear portion of the circulation fan.

8 Claims, 12 Drawing Sheets

(56) References Cited

U.S. PATENT DOCUMENTS

| | | | | |
|---|---|---|---|---|
| 5,516,012 | A | 5/1996 | Weigel | |
| 5,546,678 | A | 8/1996 | Dhaemers | |
| 5,588,313 | A | 12/1996 | Hildebrand | |
| 2003/0200773 | A1 | 10/2003 | Hong et al. | |
| 2006/0117596 | A1* | 6/2006 | Kim et al. | 34/607 |
| 2006/0196077 | A1* | 9/2006 | Choi | 34/602 |
| 2007/0209228 | A1* | 9/2007 | Meerpohl et al. | 34/595 |
| 2008/0005926 | A1* | 1/2008 | Goggin | 34/605 |
| 2008/0022552 | A1* | 1/2008 | Forget | 34/602 |
| 2009/0071033 | A1* | 3/2009 | Ahn et al. | 34/595 |
| 2011/0209357 | A1* | 9/2011 | Ediger et al. | 34/595 |

FOREIGN PATENT DOCUMENTS

| | | | |
|---|---|---|---|
| DE | 7423996 | U | 9/1977 |
| DE | 10248793 | | 11/2003 |
| DE | 10302866 | | 8/2004 |
| DE | 10-2005-052-960 | | 5/2007 |
| EP | 2107148 | | 10/2009 |
| FR | 2.159.380 | A1 | 6/1973 |
| GB | 2167172 | | 5/1986 |
| JP | 09038400 | | 2/1997 |
| JP | 11-104397 | | 4/1999 |
| JP | 2000-225299 | | 8/2000 |
| KR | 1020060095293 | A | 8/2006 |
| WO | WO 03/057968 | | 7/2003 |
| WO | 2006100335 | A1 | 9/2006 |
| WO | WO 2007/051456 | A1 | 5/2007 |
| WO | WO 2008/089668 | | 7/2008 |

* cited by examiner

CLOTHES TREATMENT APPARATUS

This application is a continuation in part application of application Ser. No. 12/219,947, filed Jul. 30, 2008 which claims the benefit of Korean Patent Application Nos. 10-2007-0078173, filed on Aug. 3, 2007 and 10-2007-0078122, filed on Aug. 3, 2007, which are hereby incorporated by reference as if fully set forth herein.

BACKGROUND OF THE INVENTION

1. Field of the Invention

The present invention relates to a clothes treatment apparatus.

2. Discussion of the Related Art

In general, clothes treatment apparatuses include washing machines for washing clothes, dryers for drying washed clothes, washing machines combined with a dryer having both washing and drying functions, and the like. There have been developed refreshers for refreshing clothes according to a recent high standard of living. A refresher functions to refresh clothes by supplying dry air to the clothes stored therein.

Therefore, a clothes treatment apparatus such as a refresher may have an airtight structure in order to refresh clothes stored therein and further to remove moisture. Such an airtight structure can enhance performance of refreshing and drying clothes.

However, this airtight structure might have a disadvantage of failure in re-opening a door of the clothes treating apparatus smoothly after closed.

SUMMARY OF THE INVENTION

Accordingly, the present invention is directed to a clothes treatment apparatus that substantially obviates one or more problems due to limitations and disadvantages of the related art.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve the objects and other advantages and in accordance with the purpose of the invention, as embodied and broadly described herein, a clothes treatment apparatus comprising a cabinet comprising an accommodating space formed therein to accommodate clothes, an air supply device configured to supply air or heated air to the accommodating space, a duct configured to guide the air or the heated air supplied by the air supply device toward the accommodating space, the duct comprising a communication part configured to draw external air into the accommodating space and a circulation fan configured to flow air along the duct, wherein the communication part is located in a rear portion of the circulation fan.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

DETAILED DESCRIPTION OF THE INVENTION

Reference will now be made in detail to the preferred embodiments of the present invention associated with a clothes treatment apparatus, examples of which are illustrated in the accompanying drawings. Wherever possible, the same reference numbers will be used throughout the drawings to refer to the same or like parts.

Reference will now be made in detail to the specific embodiments of the present invention, examples of which are illustrated in the accompanying drawings. Wherever possible, the same reference numbers will be used throughout the drawings to refer to the same or like parts.

As follows, a clothes treatment apparatus according to an exemplary embodiment of the present invention will be described in reference to the accompanying drawings.

Figure 1:
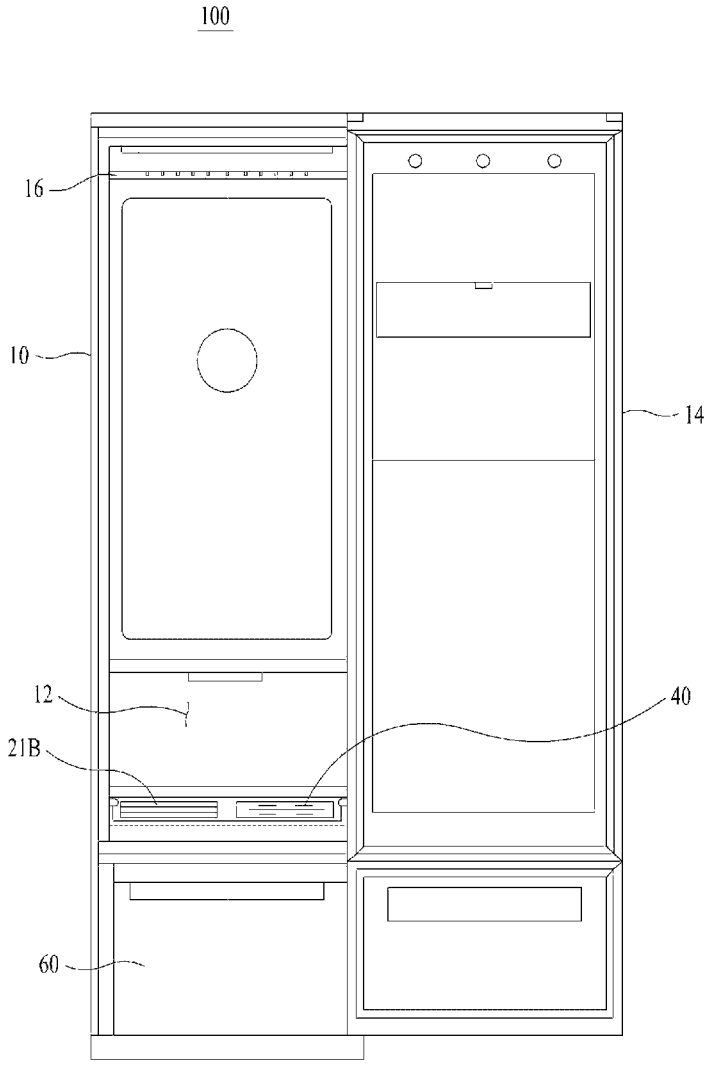
FIG. 1 is a front view illustrating a clothes treatment apparatus according to an exemplary embodiment of the present invention.

FIG. 1 is a front view illustrating that a door 14 provided in the clothes treatment apparatus according to the exemplary embodiment of the present invention is open.

This specification embodies a refresher configured to supply heated air to clothes to refresh, as clothes treatment apparatus, and the present invention is not limited thereto. A subject matter of the present invention may be applicable to other types of clothes treatment apparatuses including a heat pump, which will be described later. Here, the terminology 'refresh' means a process configured to supply air, heated air, water, mist and steam to clothes to performing wrinkles removal, deodorizing, sanitizing, static electricity prevention or warming. 'clothes' mentioned in the present specification includes not only clothes and apparel but also wearable items including shoes, socks, gloves, hats and mufflers people can wear, and usable items including dolls, towels and beddings people can use. That is, the clothes may include all kinds of clothes items of which washing may be performed.

In reference to FIG. 1, a clothes treatment apparatus 100 according to the embodiment of the present invention includes a cabinet 10 having an accommodating space formed therein to accommodate clothes, an air supply device (22, see FIG. 5) configured to supply air or heated air to the accommodating space 12, a moisture generating device (30, see FIG. 2) configured to spray water, moist or steam to the accommodating space 12 selectively, and a control part (not shown) configured to control the air supply device 22 and the moisture generating device 30.

A variety of components, which will be described later, are provided in the cabinet 10 and the accommodating space 12 to accommodate clothes therein is provided in the cabinet 10. The accommodating space 12 may be in communication with an outside by a door 14 selectively and a variety of supporters 16 configured to hang the clothes thereon are provided in the accommodating space 12. The supporters 16 may be provided to keep the clothes motionlessly still or fixed. Such the supporter may be configured to apply a predetermined movement to the clothes, when supplying air, heated air, water, mist or steam to the clothes, which will be described later. As follows, this configuration will be described in reference to FIGS. 2 and 3.

Figure 2:
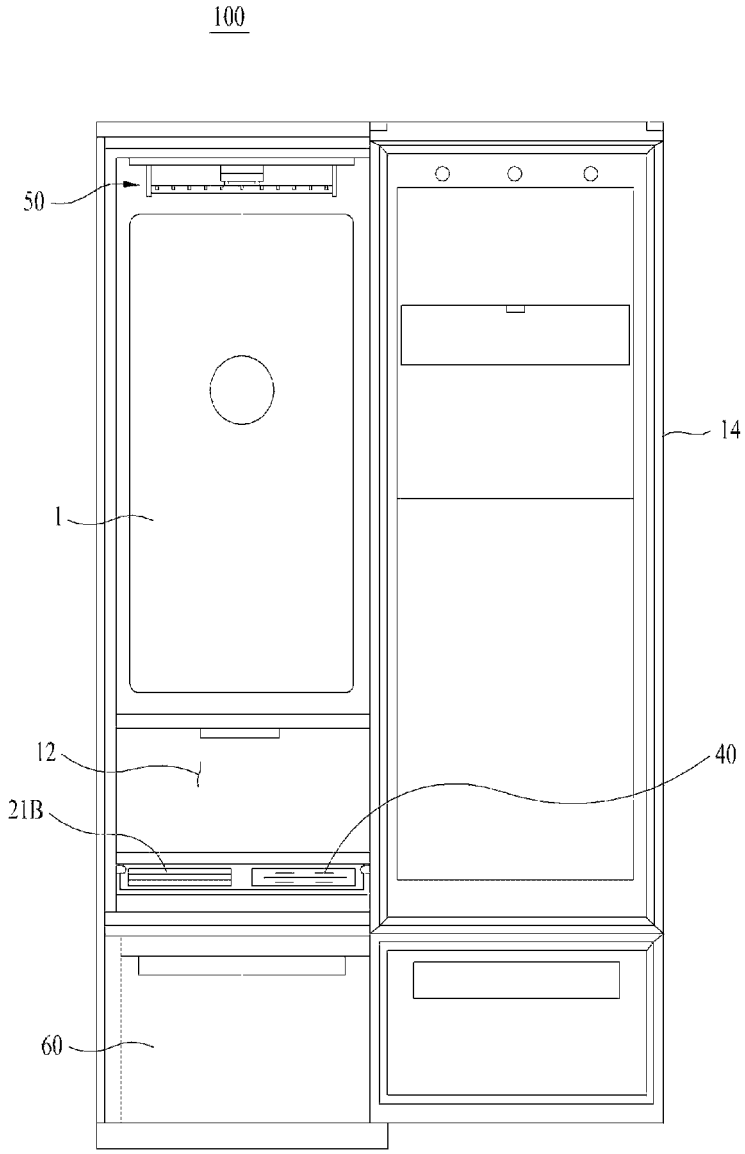
FIG. 2 is a front view illustrating a clothes treatment apparatus according to another embodiment of the present invention.

FIG. 2 is a front view illustrating a clothes treatment apparatus according to another embodiment of the present invention. Compared with the embodiment described above in reference to FIG. 1, the clothes treatment apparatus according to this embodiment includes a moving hanger configured to apply a predetermined movement to clothes, with clothes hung thereon. This difference will be described.

In reference to FIG. 2, the clothes are hung on a moving hanger 50 provided in the accommodating space 12. The moving hanger 50 may apply a predetermined movement to the clothes. When supplying air, heated air, water, mist or steam to the clothes, the predetermined movement is applied to the clothes and then a clothes refreshing effect may be improved.

Figure 3:
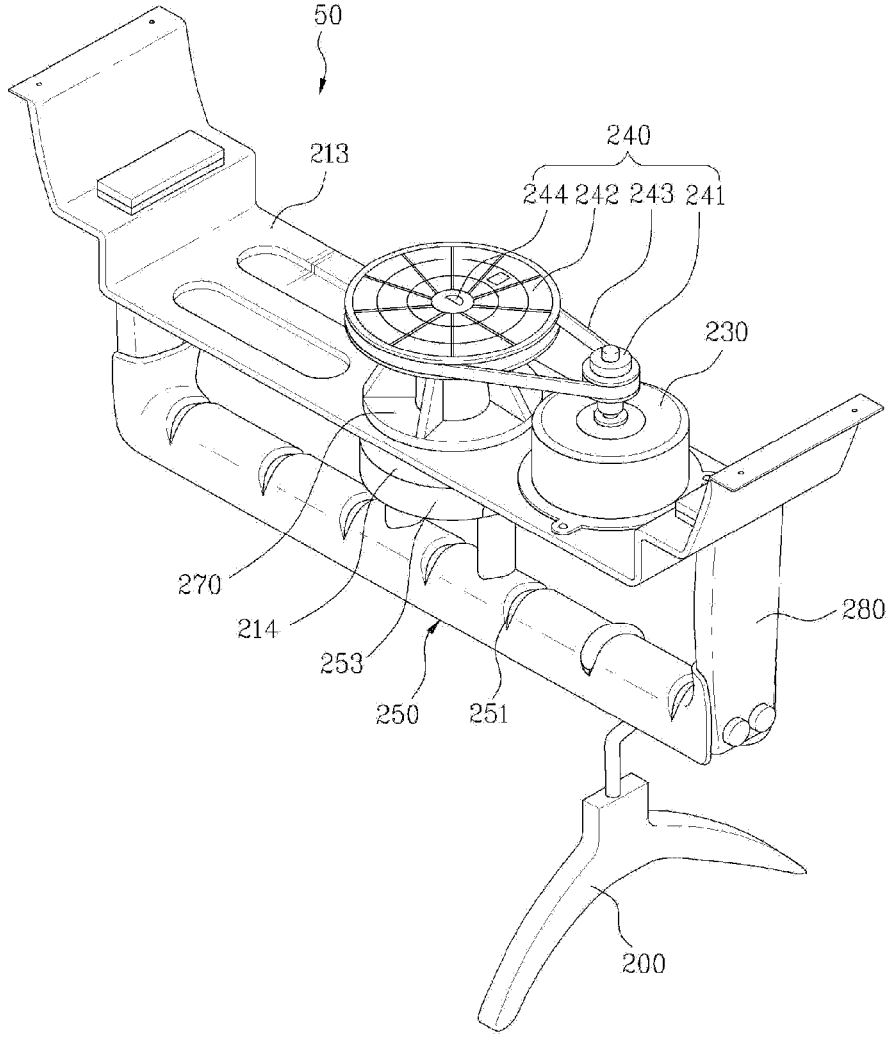
FIG. 3 is a perspective view illustrating a moving hanger shown in FIG. 2.
Figure 4:
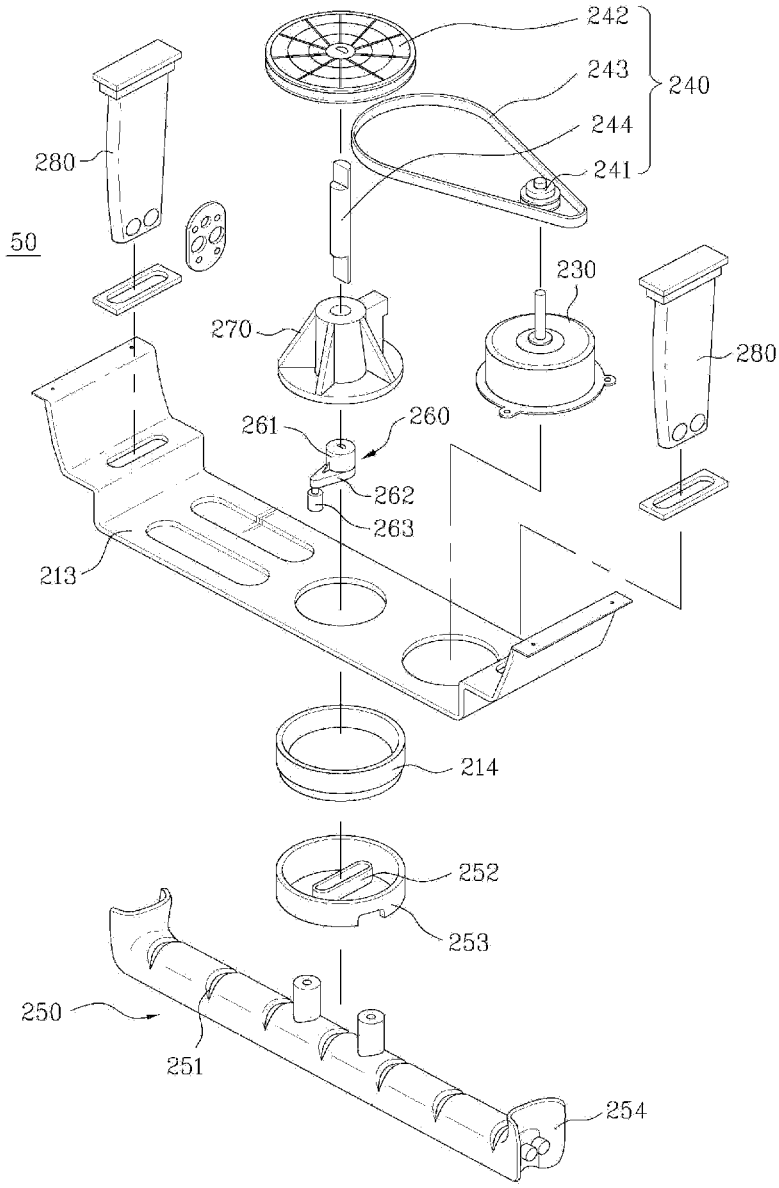
FIG. 4 is an exploded perspective view of FIG. 3.

FIG. 3 is a perspective view illustrating a configuration of the moving hanger 50 and FIG. 4 is an exploded perspective view illustrating the moving hanger 50.

In reference to FIGS. 3 and 4, the moving hanger 50 includes a hanger bar 250 configured to support clothes hung on a hanger 200 and a supporting part 280 configured to support both ends of the hanger bar 250. A plurality of hanger recesses 251 may be provided in the hanger bar 250 to fix the location of the hanger 200 hung on the hanger bar 250. The supporting part 280 is connected to a moving hanger frame 213 and the moving hanger frame 213 is provided beyond a ceiling of the cabinet 10, not to be seen outside. Both ends of the hanger bar 250 include supporting part ribs 254, respectively, and the supporting rib 254 is covering the end of the supporting part 280.

As a result, the clothes received in the clothes treatment apparatus according to the present invention are hung on at least one hanger. Because of that, not only an improved refreshing effect but also improved drying efficiency for the clothes may be expected, compared with the conventional clothes treatment apparatus.

In the meanwhile, the moving hanger 50 includes a motor 230, a power converting part 260 configured to convert a rotational force provided by the motor 230 into a horizontally linear motion of the hanger bar 250, and a power transmitting part 240 configured to transmit the power generated from the motor 230 to the power transmitting part 260.

The power transmitting part 240 includes a driving pulley 241 provided in the motor 230, a driven pulley 242 connected to the driving pulley 241 by a belt 243, and a shaft 244 coupled to a center of the driving pulley 242. The shaft 244 may be rotatably provided in a bearing housing 270 provided in the moving hanger frame 213.

The hanger bar 250 may further include a slot 252 which lies at right angles to its longitudinal direction. Specifically, a slot housing 253 is provided on the hanger bar 250 and the slot 252 is located approximately in a center of the slot housing 252. The power converting part 260 may include a slot inserting portion 263 inserted in the slot 252, a shaft connecting portion 261 connected to the shaft 244 and a rotation arm 262 connecting the slot inserting portion 263 and the shaft connecting portion 261 with each other. The power converting part 260 is covered by a cover 214 not to be seen outside and the cover 214 is provided between the moving hanger frame 213 and the slot housing 253.

Under this configuration, when the motor 230 is rotated, the driving pulley 242 is rotated and the shaft 244 coupled to the driving pulley 242 is rotated. At this time, the slot inserting portion 263 will perform a circular motion, with a predetermined diameter.

Here, the slot 252 provided in the hanger bar 250 may be orthogonal to the longitudinal direction of the hanger bar 250. By extension, the length of the slot 252 is larger than a rotational locus of the slot connecting portion 263. Because of that, the slot 252 may perform a linear motion along a horizontal direction even when the slot inserting portion 263 performs a circular motion.

In the meanwhile, a mechanism chamber 20 configured to accommodate the air supplying device 22 and the moisture generating device 30 may be provided in the cabinet 10. The mechanism chamber 20 may be located below the accommodating space 12 and it includes the air supplying device 22 and the moisture generating device 30 received therein. The reason why the mechanism chamber 20 is located below the accommodating space 12 is that the heated air or steam supplied to the accommodating space 12 has a property of ascending and that the mechanism chamber 20 is located below the accommodating space 12 to supply the heated air or steam upwardly.

Figure 5:
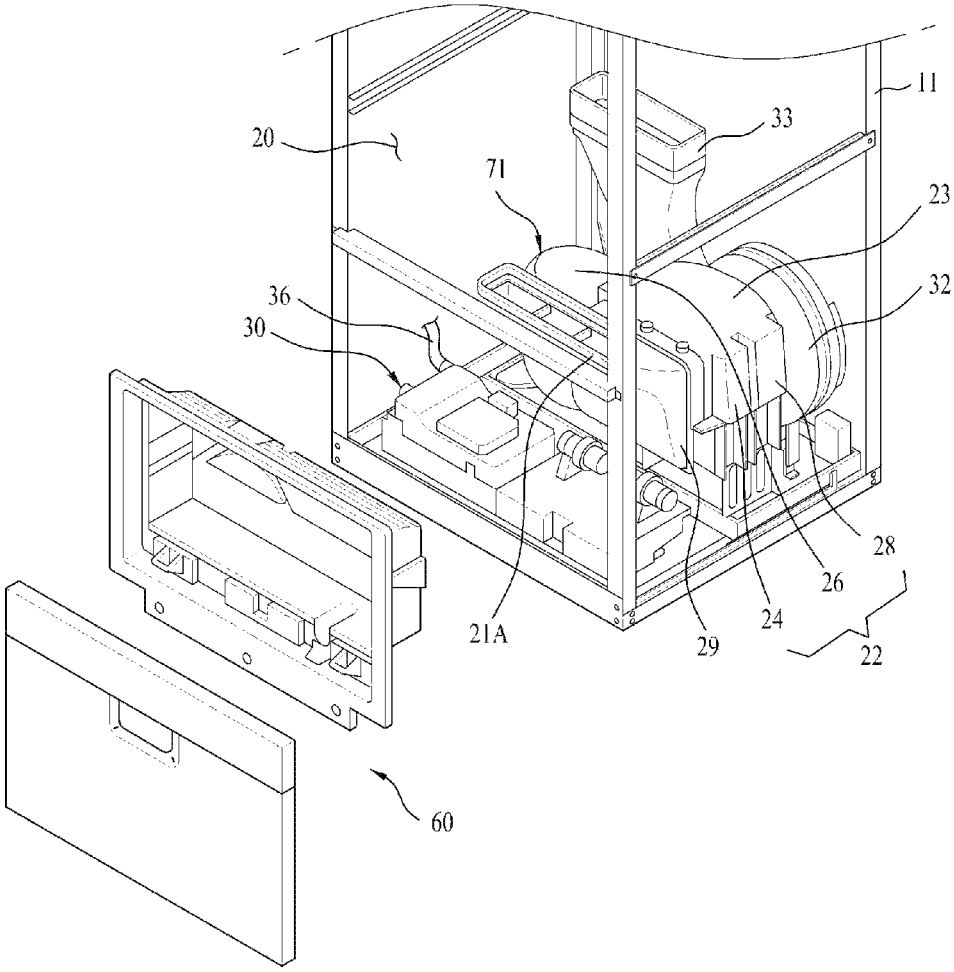
FIG. 5 is a diagram schematically illustrating an inner configuration of a mechanism chamber.

FIG. 5 is a perspective view schematically illustrating an inner configuration of the mechanism chamber 20. To illustrate the inner configuration of the mechanism chamber 20, only a frame 11 of the cabinet 10 is shown in FIG. 5 for convenience sake. In addition, only main components including the air supplying device 22 and the moisture generating device 30 are illustrated in FIG. 5 for convenience sake and a drainage line connecting those components with each other is not illustrated.

In reference to FIG. 5, the air supplying device 22 configured to supply air or heated air to the accommodating space 12 may be located within the mechanism chamber 20.

A heat pump 22 embodied as the air supplying device according to the present invention may include an evaporator 24, a compressor 26, a condenser 28 and an expansion valve (not shown) which allow refrigerant to flow there through. Because of that, air is dehumidified and heated.

In other words, latent heat of ambient air is absorbed, while refrigerant is evaporated in the evaporator 24. After that, air is cooled and moisture contained in the air is condensed and eliminated. When refrigerant is condensed in the condenser 28 after passing the compressor 26, latent heat is exhausted toward ambient air. After that, the ambient air may be heated. As a result, the evaporator and the condenser 28 are functioned as heat exchanger. The air sucked into the mechanism chamber 20 may be dehumidified and heated while passing the evaporator 24 and the condenser 28, to be supplied to the accommodating space 12.

The air heated by the heat pump 22 has a relatively lower temperature than the air heated by a conventional electric heater. However, the air heated by the heat pump 22 may be dehumidified without using any auxiliary dehumidifying device. As a result, the air re-supplied to the accommodating space 12 by the heat pump 22 may be corresponding to 'relatively low dry air' (here, the term of 'low temperature' means not an absolutely low temperature but a relatively lower temperature than the temperature of conventional heated air). The clothes treatment apparatus according to the embodiment of the present invention may supply low temperature dry air to the clothes. Because of that, the clothes treatment apparatus according to the embodiment of the present invention may prevent deformity or damage which might be generated by the high temperature of heated air used in performing refreshing or drying for the clothes. That is, the air supplied by the heat pump 22 in the clothes treatment apparatus according to the embodiment of the present invention may have the lower temperature than the hot air supplied in the conventional clothes treatment apparatus but it may be dehumidified without any auxiliary dehumidifying device, to dry and refresh the clothes efficiently and smoothly.

Specifically, an air inlet (21A, see FIG. 5) is formed in a front portion of a top of the mechanism chamber 20 suck air of the accommodating space 12 into the mechanism chamber 20. An air path of the air may be formed by an inlet duct 29 configured to connect the air inlet 21A, the evaporator 24, the condenser 28 and the fan 32 with each other. The air drawn into the mechanism chamber 20 via the air inlet 21A by the inlet duct 29 may be dehumidified and heated while passing the heat pump 22. The dehumidified and heated air may be re-supplied to the accommodating space 12 via an outlet duct 33 and an air outlet 21B by a fan 32.

Here, although not shown in the drawings, a filter may be provided in the air inlet 21A. The filter provided in the air inlet 21A may filter various foreign substances contained in the air drawn into the mechanism chamber 20 from the accommodating space 12 and only fresh air can be re-supplied to the accommodating space 12.

Furthermore, the moisture generating device 30 may be provided in the mechanism chamber 20 to supply water, mist or steam (hereinafter, referenced to as 'steam') to the accommodating space 12 selectively.

The moisture generating device 30 includes a heater (not shown) configured to heat water and the water is heated to generate steam. The moisture generating device 30 supplies the generated steam to the accommodating space 12. An external water tap may be used as water supply source supplying water to the moisture generating device 30 or a water supplying tank (not shown) may be provided in a predetermined portion of the mechanism chamber 20 as water supply source.

The water supplying tank may be provided in a door module 60 detachably installed in a predetermined portion of the mechanism chamber 20. Because of that, a user may separate the water supplying tank from the mechanism chamber 20 for water refill and he or she may re-install the tank.

Also, the steam generated in the moisture generating device 30 is supplied to the accommodating space 12 via a steam hose 36 and a steam nozzle (40, see FIGS. 1 and 2). In this case, it is more preferable, as the shorter the steam hose 36 is, to prevent the temperature of the steam from being lowered or condensed while the steam moving through the steam hose 36. When the mechanism chamber 20 is located below the accommodating space 12, the steam nozzle 40 may supply steam via a top of the mechanism chamber 20 which is a bottom of the accommodating space 12.

A circulating fan (not shown) may be provided in a rear portion of the mechanism chamber 20 and the circulating fan supplies external air to the mechanism chamber 20. Because of that, the internal air of the mechanism chamber 20 may be prevented from increasing too much when the heat pump 22 and the moisture generating device 30 are put into operation. In the meanwhile, the clothes treatment apparatus keeps clothes therein and a user can have such the clothes treatment apparatus installed in a living room or a bed or power room accordingly. However, an internal room of the clothes treatment apparatus forms a kind of an airtight structure. Because of that, when trying to re-open the door which is closed, there might be a disadvantage of failure in re-opening the door. When the heated air or the steam is supplied, it is important to make the supplied heated air or steam not leaked outside and to make the internal room of the clothes treatment apparatus not kept airtight simultaneously. For that, the clothes treatment apparatus 100 described above may include a communication part configured to make the accommodating space 12 communicate with an outside of the cabinet 10 or to make external air sucked into the circulation duct. In other words, the circulation duct is connected with the accommodating space 12 and it may form a kind of an airtight structure. When the structure capable of enabling external air to be sucked is provided in the circulation duct, the internal room may be prevented from being airtight. However, heated air could be circulated in the circulation duct and the heated air might be leaked outside via the airtight structure. If then, refreshing efficiency could deteriorate in case of refreshing clothes. When the heated air is supplied, it is preferable that the above airtight structure is configured to prevent the heated air from leaking outside. As follows, the airtight structure will be described in reference to corresponding drawings.

Figure 6:
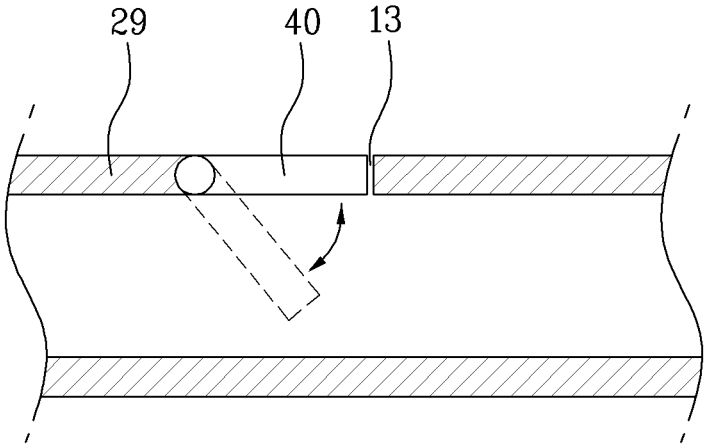
FIG. 6 is a sectional view illustrating a configuration of a communication part according to an embodiment.

FIG. 6 is a sectional view schematically illustrating a constitution of a communication part according to a first embodiment of the present invention.

Referring to FIG. 6, a communication part according to this embodiment includes a ventilation door 40 which is coupled to the circulation duct 29 so as to be pivoted at a predetermined angle. When hot air is supplied, the ventilation door 40 is closed by the hot air. When hot air is not supplied, the ventilation door 40 is pivoted by its own weight to be opened.

In particular, the ventilation door 40 is rotatably mounted to a predetermined portion of the circulation duct 29. As shown in FIG. 6, it is preferred that the ventilation door is kept in a horizontal state when closing an opening portion 13. Accordingly, the opening portion 13, as shown in FIG. 6, is preferably formed at an upper portion of the circulation duct 29.

Because the hot air flowing through the circulation duct 29 moves by the operation of the fan 32, the hot air has a pressure higher than a predetermined value. Therefore, when the hot air flows through the circulation duct 29 by the operation of the fan 32, the ventilation door 40 is not pivoted down, and is kept to close the opening portion 13 by the pressure of the hot air, as shown by a solid line of FIG. 6.

On the other hand, when the operation of the hot air supplying device is terminated and the hot air supply by the fan 32 is not performed, the ventilation door 40 is pivoted down by its own weight, as shown by an arrow direction of FIG. 6, and opens the opening portion 13. Accordingly, external air is introduced into the circulation duct 29 through the opened opening portion 13, and is supplied to the accommodating space 12, to thereby achieve the ventilation and prevent the accommodating space 12 from being airtight.

Figure 7:
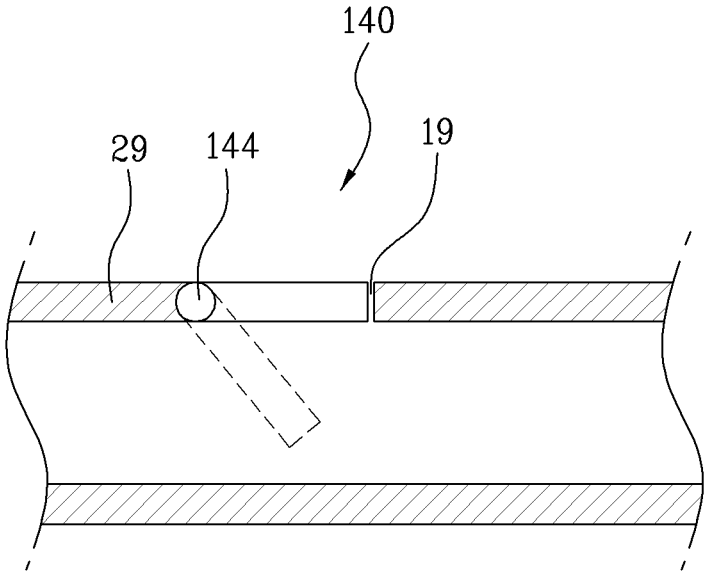
FIG. 7 is a sectional view illustrating a configuration of a communication part according to another embodiment.

FIG. 7 is a sectional view schematically illustrating a constitution of a communication part according to a second embodiment of the present invention. A communication part of this embodiment has difference from the communication part of the previous embodiment shown in FIG. 6, in that the communication part is controlled to selectively open an opening portion by a control unit.

Referring to FIG. 7, a communication part of a second embodiment may include an opening portion 19 for communicating the accommodating space 12 of the cabinet 10 with the outside, an opening/closing part 140 for selectively opening the opening portion 19, and a control unit (not shown) for controlling the opening/closing part 140. In this embodiment, the opening/closing part 140 is controlled to selectively open the opening portion by the control unit, to thereby achieve the ventilation.

In particular, the opening portion 19 serves to communicate the accommodating space 12 with the outside. Preferably, the opening portion 19 is formed at a predetermined portion of the circulation duct 29 to communicate the accommodating space 12 with the outside.

The opening/closing part 140 includes a door 142 rotatably mounted to a predetermined portion of the opening portion 19, and a driving part 144 which is controlled to rotate the door 142 by the control unit. Accordingly, the driving part 144 is operated by the control unit, and the door 142 is pivoted by the operation of the driving part 144, to open or close the opening portion 19.

In particular, when the operation of the hot air supplying device is terminated and the hot air supply is not performed, the control unit controls the driving part 144 to operate to open the door 142, so that external air is introduced into the circulation duct 29. In such a case, it is preferred that after the operation of the hot air supplying device is terminated, the control unit controls the door 142 to be opened in a predetermined time, e.g., 5 to 10 minutes. This is because if the door 142 is opened immediately after the operation of the hot air supplying device is terminated, the hot air remaining in the accommodating space 12 is exhausted outside through the opening portion 19, and thus the drying of clothes is not smoothly achieved.

Also, it is preferred that the control unit controls the door 142 to be opened at a predetermined period, e.g., for 5 minutes with an interval of 30 minutes. If the door 142 is kept in an opened state while hot air is not supplied, there is possibility that external foreign substances such as dust enter the cabinet 10 and damage clothes. Accordingly, it is preferred that the control unit controls the door 142 to be periodically opened so as to minimize introduction of foreign substances into the cabinet 10 while realizing the ventilation.

Although it is illustrated in FIG. 7 that the door 142 communicates the accommodating space 12 with the outside, the present invention is not limited to such a structure and can be diversely modified. For example, the present invention may employ a valve for communicating the accommodating space 12 with the outside.

In the meanwhile, when the communication part is provided along the duct as described above, the air inlet and the air outlet may be differentiated according to the location of the communication part. Especially, the opening and closing of the door may be differentiated according to the location of the door in the configuration of the door which is closed by the pressure of the air moving along the duct as shown in FIG. 3. For example, if the door is located distant from the fan for blowing air, the distance between the door and the fan is quite far and it is then difficult for the air passing the door to have the predetermined pressure or more required to close the door even, even in the driving of the fan. In this case, if the fan is driven for the air to have the pressure enough to close the door, the fan could be overdriven. Because of that, when the communication part is provided to have the structure enabling the air pressure to close the door, it is preferable that the communication part and the door are provided adjacent to the fan, which will be described in reference to FIGS. 8 and 9.

Figure 8:
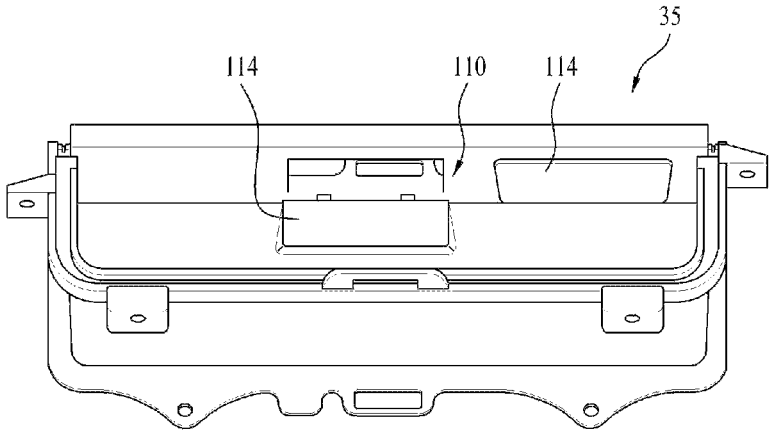
FIG. 8 is a perspective view illustrating a communication part according to a third embodiment.
Figure 9:
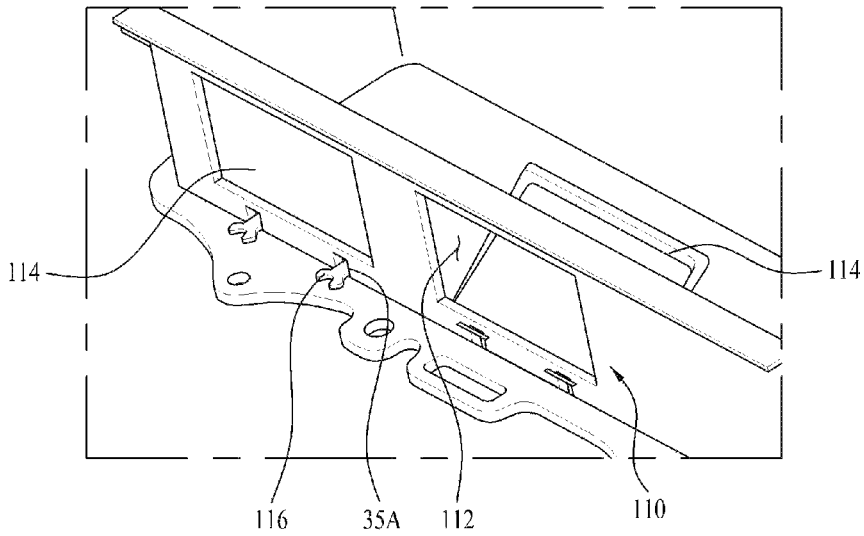
FIG. 9 is a partially enlarged view of the communication part shown in FIG. 8.

FIG. 8 is a perspective view illustrating a communication part 110 according to a third embodiment and FIG. 9 is a partially enlarged view of FIG. 8.

In reference to FIGS. 8 and 9, the communication part 110 may be provided along the circulation duct. By extension, the communication part 110 can be selectively opened and closed to prevent leakage of the heated air when the heated air is supplied as described above.

For example, when the air or the heated air is supplied, the communication part 110 may be configured to be closed. Only when the air or the heated air is not supplied, the communication part 110 may be configured to be open. As a result, the communication part 110 may includes at least one opening 112 provided in the circulation duct and a door 114 rotatably provided to open and close the opening 112 selectively. In other words, the door 114 is rotated to open the opening 112 selectively such that airtightness may be prevented.

Specifically, it is preferable that the door 114 opens the opening 112 when the air or the heated air is not supplied, in other words, when the circulation fan is not driven. Especially, when the circulation fan 32 is not put into operation, the door 114 may open the opening 112 by its self-weight. For that, the door 114 may be rotatably provided adjacent to the opening 112. When the circulation fan 32 is not driven, the door 114 is rotated downward by its weight and it opens the opening 112. Also, when the air or the heated air is supplied, in other words, when the circulation fan 32 is driven, the air or the heated air having the predetermined pressure may be supplied by the circulation fan. Because of that, the pressure of the air or the heated air rotates the door 114 only to open the opening 112.

As a result, the door 114 of the communication part 110 is closed when the air or the heated air having the predetermined pressure is supplied by the driving of the circulation fan 32. Because of that, it is preferable that the door 114 of the communication part is provided adjacent to the circulation fan 32. For example, the communication part 110 may be located in a rear portion of the circulation fan 32. When the air or the heated air having the predetermined pressure is supplied by the driving of the circulation fan 32, the pressure of the air or the heated air may close the door 114 smoothly. In the meanwhile, an end of the circulation duct may be connected with the air outlet 21B configured to supply the air or the heated air to the accommodating space 12. Specifically, an end of the outlet duct 33 composing the circulation duct may be connected with the air outlet 21B. Because of that, the communication part 110 may be provided between the circulation duct and the air outlet 21B, in the rear portion of the circulation fan 32 within the outlet duct 33.

In the meanwhile, the outlet duct 33 may be connected with the housing 23 configured to surround the evaporator 24 and the condenser 28, which compose the heat pump, as mentioned above. The housing 23 may be provided on a bottom of the mechanism chamber 20. In addition, the air outlet 21B connected with the outlet duct 33 is provided in a bottom of the accommodating space 12. When the outlet duct 33 is directly connected with the air outlet 21B, there might be a distance between the outlet duct 33 and the air outlet 21B or there might be little distance between them to result in connection difficulty. As a result, to solve this disadvantage, a connection duct 35 may be further provided to connect the outlet duct 33 and the air outlet 21B with each other. The connection duct 35 may be formed of a flexible material and it may adjust a distance when connecting the outlet duct 33 and the air outlet 21B with each other. Because of that, the connection duct 35 may connect the outlet duct 33 and the air outlet 21B with each other, corresponding to the distance between them.

In the meanwhile, the communication part 110 mentioned above may be provided in the outlet duct 33 located between the circulation duct and the air outlet 21B or it may be provided in the connection duct 35 mentioned above. FIG. 8 illustrates an embodiment presenting the communication part 110 provided in the connection duct 35.

As shown in FIG. 8, the communication part 110 includes at least one opening 112 formed in a predetermined portion of the connection duct 35. A single opening 112 may be formed or two or more openings 112 maybe formed according to the volume of the accommodating space 12 and the like. The communication part 110 may further include a door 114 rotatably provided, with being adjacent to the opening 112. As mentioned above, the door 114 is opened by its self weight and it is closed by the pressure of the air or the heated air when the air or the heated air is supplied by the circulation fan 32. Because of this structure, the door 114 is adjacent to a lower portion of the opening 112. The rotatable structure of the door 114 may be embodied in various ways. For example, a hole 35A is provided below the opening 112 and a hooking projection 116 corresponding to the hole 35A is provided in the door 114. As a result, the hooking projection 116 is inserted in the hole 35A and the door 114 is then rotatable by the hooking projection 116.

Figure 10:
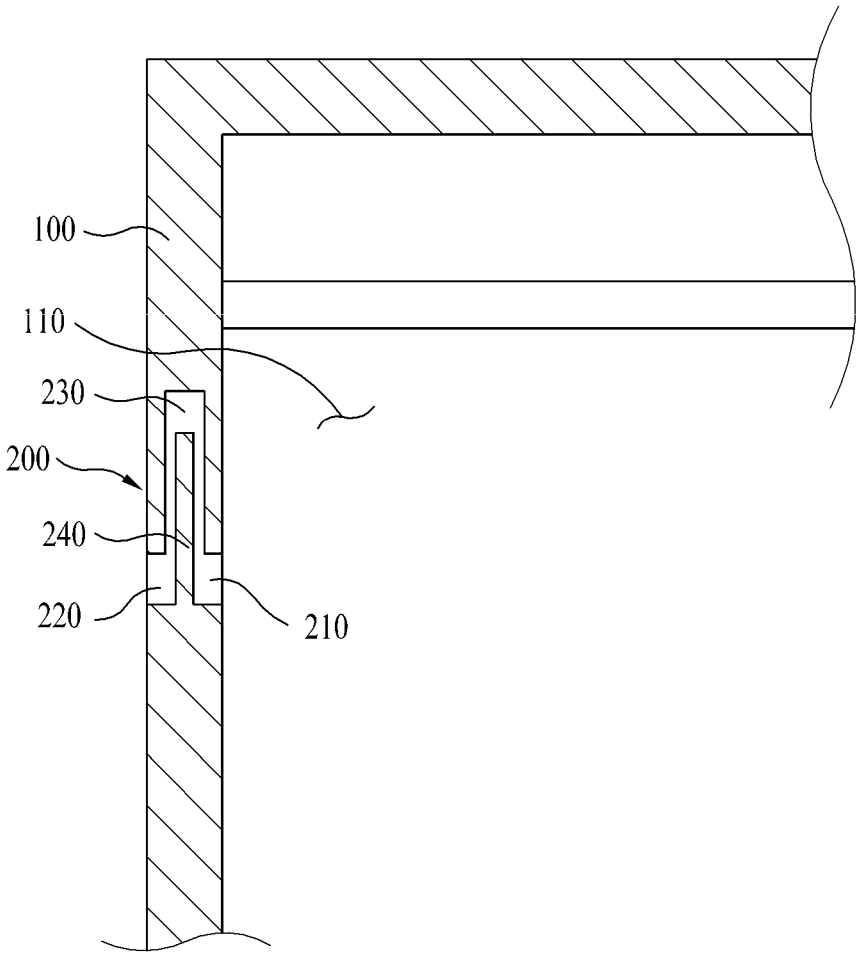
FIG. 10 is a sectional view illustrating a configuration of a communication part according to a fourth embodiment.

FIG. 10 is a partial side-sectional view illustrating a cabinet formed with a communication part according to a fourth embodiment of the present invention.

Referring to FIG. 10, a communication part 200 of a fourth embodiment includes a first hole 210 formed at an inner surface of the cabinet 100, and a second hole 220 formed at an outer surface of the cabinet 100. A communicating channel 230 is formed between the first hole 210 and the second hole 220, through which air flows.

The communicating channel 230 serves to communicate the accommodating space 110 in the cabinet 100 with the outside. In order to prevent the hot air or the steam supplied to the accommodating space 110 from leaking out, the communicating channel 230 is formed to be bent at one point or more. In order to form the bent communicating channel 230, at least one projection portion 240 is provided along the channel.

The projection portion 240 is provided in the communicating channel 230 between the first hole 210 and the second hole 220, so that the communicating channel 230 is formed to be bent. Such a projection portion 240 functions as resistance to the hot air or the steam flowing through the communicating channel 230. Accordingly, although the accommodating space 110 communicates with the outside by the communicating channel 230, excessive leakage of the hot air or the steam supplied to the accommodating space 110 is prevented.

The projection portion 240 may be provided in a single number, and may also be provided in plural numbers to form the communicating channel 230 in a zigzag shape so as to further decrease the outflow amount of air from the first hole 210 to the second hole 220 and thereby enhance the leakage-preventing effect.

Preferably, the communication part 200 for communicating the inside of the cabinet 100 with the outside is formed near a corner of the cabinet 100. This is because when steam or hot air is supplied to the cabinet 100, an inner region near the corner of the cabinet 100 forms a so-called "dead zone", to which the smallest amount of steam or hot air is supplied. Therefore, if the communication part 200 is formed near such a "dead zone", it is possible to maximize the effect of preventing leakage of the steam or the hot air from the cabinet 100.

Figure 11:
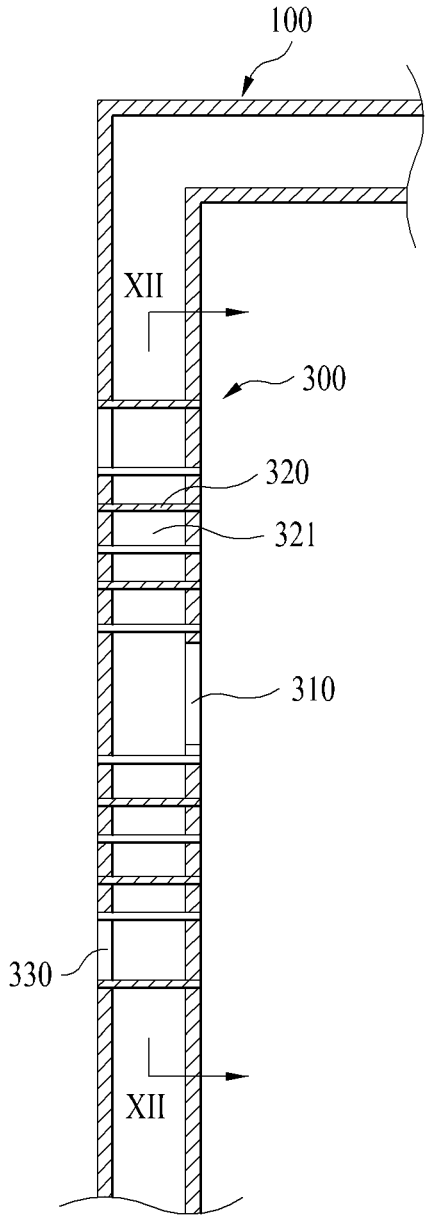
FIG. 11 is a sectional view illustrating a configuration of a communication part according to a fifth embodiment.
Figure 12:
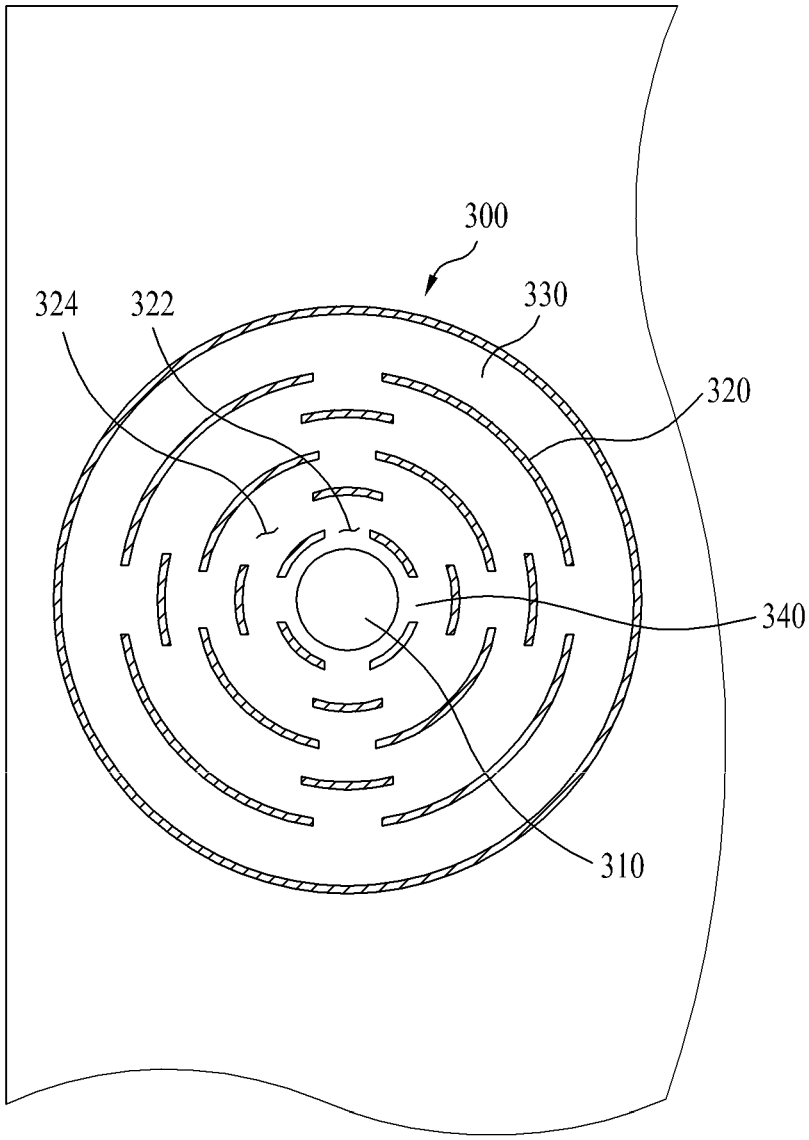
FIG. 12 is a sectional view of FIG. 11 along XII-XII line.

FIG. 11 is a partial side-sectional view illustrating a cabinet formed with a communication part according to a fifth embodiment of the present invention, and FIG. 12 is a sectional view taken along line XII-XII of FIG. 11. A communication part of a fifth embodiment has difference from the communication part of the fourth embodiment in a method of forming a communicating channel to be bent, which will be explained in detail hereinafter.

Referring to FIGS. 11 and 12, a communication part 300 of a fifth embodiment includes a plurality of partition walls 320, so as to form a communicating channel 340 to be bent. The partition walls 320, as shown in FIGS. 11 and 12, may be formed in a concentric circle shape centering on a first hole 310, and a second hole 330 may be formed along an outer surface of one of the partition walls 320.

The partition walls 320 may be formed with communicating holes 322 and 324 for defining a communicating channel 340 connecting the first hole 310 and the second hole 330. In other words, the communicating channel 340 is formed along the communicating holes 322 and 324 formed at the partition walls 320 from the first hole 310, and is connected to the second hole 330.

In such a case, in order to form the communicating channel 340 to be bent, it is preferred that the communicating holes 322 and 324 formed at the partition walls 320 are positioned alternately to each other. In other words, as shown in FIG. 12, each of the first communicating holes 322 and each of the second communicating holes 324 are not aligned with each other in a radial direction from the first hole 310, and are arranged alternately to each other in a radial direction so as to form the communicating channel 340 to be bent. As such, if the communicating holes 322 and 324 are arranged alternately to each other, the communicating channel 340 connecting the communicating holes 322 and 324 is formed to be bent in a so-called "maze structure". Accordingly, similar to the aforementioned embodiments, although the communication part 300 of this embodiment communicates the inside of the cabinet 100 with the outside, excessive leakage of the hot air or the steam supplied to the cabinet 100 is prevented.

The communication part is not limited to the above-described structure, and can be modified diversely.

As described above, the clothes treatment apparatus according to the present invention can prevent leakage of hot air or steam from the accommodating space and it can prevent deterioration of efficiency of the clothes treatment apparatus by allowing external air to be introduced into the accommodating space.

As apparent from the above description, the clothes treatment apparatus according to the present invention includes the communication part for communicating the accommodating space with the outside.

Further, because external air is allowed to be introduced into the accommodating space, the performance of the clothes treatment apparatus can be enhanced.

Still further, by virtue of the communication part for communicating the accommodating space with the outside, the inner space of the clothes treatment apparatus can be prevented from being odorized.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A clothes treatment apparatus comprising:

a cabinet comprising an accommodating space formed therein to accommodate clothes;

an air supply device configured to supply air or heated air to the accommodating space;

a duct configured to guide the air or the heated air supplied by the air supply device toward the accommodating space, wherein the duct comprises:

an inlet duct configured to supply the air inside the accommodating space to the air supply device; and an outlet duct configured to supply the air exhausted from the air supply device to the accommodating space, a circulation fan provided in the duct and configured to circulate the air inside the accommodating space along the duct; and a communication part comprising at least one opening provided in the outlet duct and a door provided to open and close the opening to draw external air into the accommodating space.

2. The clothes treatment apparatus of claim 1, further comprising:

a mechanism chamber provided below the accommodating space within the cabinet, wherein the air supply device and the duct are provided in the mechanism chamber.

3. The clothes treatment apparatus of claim 1, wherein the door opens the opening by using a self weight thereof and the door closes the opening by using air having a predetermined pressure supplied by the circulation fan.

4. The clothes treatment apparatus of claim 3, further comprising:

a connection duct configured to connect the outlet duct with an air outlet provided in the accommodating space to communicate with the outlet duct, and the communication part is provided in the connection duct.

5. The clothes treatment apparatus of claim 1, wherein the air supply device is configured of a heat pump comprising an evaporator, a compressor and a condenser where refrigerant is circulated.

6. The clothes treatment apparatus of claim 1, further comprising:

a moving hanger having clothes hung thereon, the moving hanger configured to apply a predetermined motion to the clothes.

7. The clothes treatment apparatus of claim 1, further comprising:

a moisture generating device configured to supply water, mist or steam to the accommodating space selectively.

8. The clothes treatment apparatus of claim 1, wherein the communication part draws external air into the accommodating space when the air supply device does not operate.

* * * * *